US006409471B1

(12) United States Patent
Stow

(10) Patent No.: US 6,409,471 B1
(45) Date of Patent: Jun. 25, 2002

(54) SHROUD ASSEMBLY AND METHOD OF MACHINING SAME

(75) Inventor: Jonathan J. Stow, Hamilton, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/785,765

(22) Filed: Feb. 16, 2001

(51) Int. Cl.[7] ..... F01D 11/08
(52) U.S. Cl. ..... 415/173.1; 29/888.2; 29/888.22
(58) Field of Search ..... 415/173.1, 173.2, 415/174.4, 9; 29/889.2, 889.21, 889.22, 889.1, 434, 428

(56) References Cited

U.S. PATENT DOCUMENTS 4,195,964 A 4/1980 Kraft et al.
4,363,599 A 12/1982 Cline et al.
4,767,272 A 8/1988 Kildea
4,999,991 A 3/1991 Haddad et al.
5,054,997 A * 10/1991 Corsmeier et al. ..... 415/173.2
5,211,534 A 5/1993 Catlow
5,212,940 A * 5/1993 Glover ..... 415/115
5,281,085 A * 1/1994 Lenahan et al. ..... 415/173.2
5,439,348 A 8/1995 Hughes et al.
5,462,403 A * 10/1995 Pannone ..... 415/173.1
5,639,210 A * 6/1997 Carpenter et al. ..... 415/135
5,667,358 A 9/1997 Gaul
5,871,333 A 2/1999 Halsey

* cited by examiner

*Primary Examiner*—Edward K. Look
*Assistant Examiner*—Igor Kershteyn
(74) *Attorney, Agent, or Firm*—V. Ramaswamy; Senniger, Powers, Leavitt & Roedel

(57) ABSTRACT

A method of machining an inner surface of a shroud assembly extending generally circumferentially around a central axis of a gas turbine aircraft engine. The method includes determining pre-machined radial clearances during flight between tips of rotor blades in the engine and the inner surface of the shroud assembly at each of a plurality of circumferentially spaced locations around the shroud assembly. The inner surface of the shroud assembly is machined based on the pre-machined radial clearances to provide a generally uniform post-machined radial clearance during flight between the tips of the rotor blades and the inner surface of the shroud assembly at each of the circumferentially spaced locations around the shroud assembly.

17 Claims, 3 Drawing Sheets

SHROUD ASSEMBLY AND METHOD OF MACHINING SAME

BACKGROUND OF THE INVENTION

The present invention relates generally to gas turbine engine shroud assemblies, and more particularly, to shroud assemblies having an inner surface machined to minimize blade tip clearances during flight.

Gas turbine engines have a stator and one or more rotors rotatably mounted on the stator. Each rotor has blades arranged in circumferential rows around the rotor. Each blade extends outward from a root to a tip. The stator is formed from one or more tubular structures which house the rotor so the blades rotate within the stator. Minimizing clearances between the blade tips and interior surfaces of the stator improves engine efficiency.

The clearances between the blade tips and the interior surfaces change during engine operation due to blade tip deflections and deflections of the interior surfaces of the stator. The deflections of the blade tips result from mechanical strain primarily caused by centrifugal forces on the spinning rotor and thermal growth due to elevated flowpath gas temperatures. Likewise, the deflections of the interior surfaces of the stator are a function of mechanical strain and thermal growth. Consequently, the deflections of the rotor and stator may be adjusted by controlling the mechanical strain and thermal growth. In general, it is desirable to adjust the deflections so the clearances between the rotor blade tips and the interior surfaces of the stator are minimized, particularly during steady-state, in-flight engine operation.

Stator deflection is controlled primarily by directing cooling air to portions of the stator to reduce thermally induced deflections thereby reducing clearances between the blade tips and the interior surfaces of the stator. However, because the cooling air is introduced through pipes at discrete locations around the stator, it does not cool the stator uniformly and the stator does not maintain roundness when the cooling air is introduced. In order to compensate for this out-of-round condition, the inner surfaces of the stator are machined so they are substantially round during some preselected condition. In the past, the preselected condition at which the stator surfaces were round was either when the engine was stopped or when the engine was undergoing a ground test. However, it has been observed that machining the stator so its inner surfaces are substantially round during either of these conditions results in the inner surfaces being out of round during actual flight. Because the inner surfaces are out of round during flight, the clearances between the blade tips and the inner surfaces of the stator vary circumferentially around the engine and are locally larger than need be. As a result, engine efficiency is lower than it could be if the stator inner surfaces were round during flight.

SUMMARY OF THE INVENTION

Among the several features of the present invention may be noted the provision of a method of machining an inner surface of a shroud assembly extending generally circumferentially around a central axis of a gas turbine aircraft engine. The engine includes a disk mounted inside the shroud assembly for rotation about the central axis of the engine and a plurality of circumferentially spaced rotor blades extending generally radially outward from an outer diameter of the disk. Each of the blades extends from a root positioned adjacent the outer diameter of the disk to a tip positioned outboard from the root. The method comprises determining a pre-machined radial clearance between the tips of the rotor blades and the inner surface of the shroud assembly during flight of the aircraft engine at each of a plurality of circumferentially spaced locations around the shroud assembly. Further, the method includes machining the inner surface of the shroud assembly based on the pre-machined radial clearances to provide a generally uniform post-machined radial clearance during flight between the tips of the rotor blades and the inner surface of the shroud assembly at each of the circumferentially spaced locations around the shroud assembly.

In another aspect, the present invention is directed to a shroud assembly for use in a gas turbine engine. The assembly extends generally circumferentially around a central axis of the gas turbine aircraft engine and surrounds a plurality of blades rotatably mounted in the engine. Each of the blades extends outward to a tip. The assembly comprises an inner surface extending generally circumferentially around the engine and outside the tips of the blades when the shroud assembly is mounted in the engine. The inner surface has a radius which varies circumferentially around the central axis of the engine before flight but which is substantially uniform during flight to minimize operating clearances between the inner surface and the tips of the blades.

In still another aspect, the shroud assembly comprises an inner surface spaced from a central axis of the engine by a distance which varies circumferentially around the central axis of the engine when the engine is stopped. The inner surface has a first locally maximum distance when the engine is stopped located at about 135 degrees measured clockwise from a top of the assembly and from a position aft of the surface. The first locally maximum distance is about 0.010 inches larger than a minimum distance of the inner surface. The inner surface has a second locally maximum distance when the engine is stopped at about 315 degrees measured clockwise from the top and from the aft position. The second locally maximum distance is about 0.005 inches larger than the minimum distance of the inner surface.

In yet another aspect, the shroud assembly comprises an annular support having a center corresponding to the central axis of the engine and a plurality of shroud segments mounted in the support extending substantially continuously around the support to define an inner surface of the shroud assembly. The inner surface is machined by grinding the surface to a radius of about 14.400 inches about a first grinding center corresponding to the center of the support, grinding the surface to a radius of about 14.395 inches about a second grinding center offset about 0.015 inches from the first grinding center in a first direction extending about 135 degrees from a top of the assembly measured clockwise from an aft side of the support, and grinding the surface to a radius of about 14.390 inches about a third grinding center offset about 0.015 inches from the first grinding center in a second direction generally opposite to the first direction.

Other features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
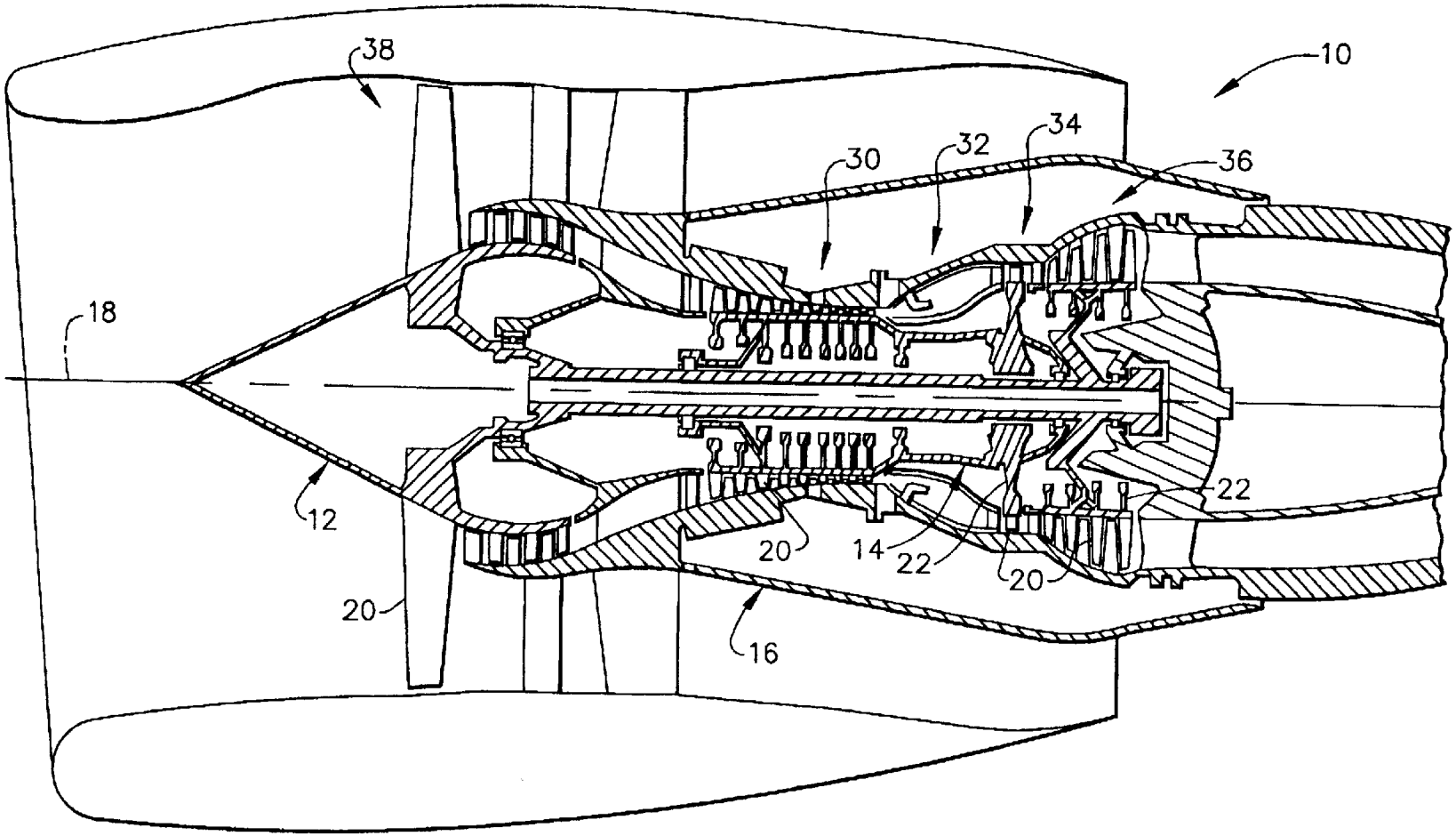
FIG. 1 is a schematic vertical cross section of a gas turbine aircraft engine.
Figure 2:
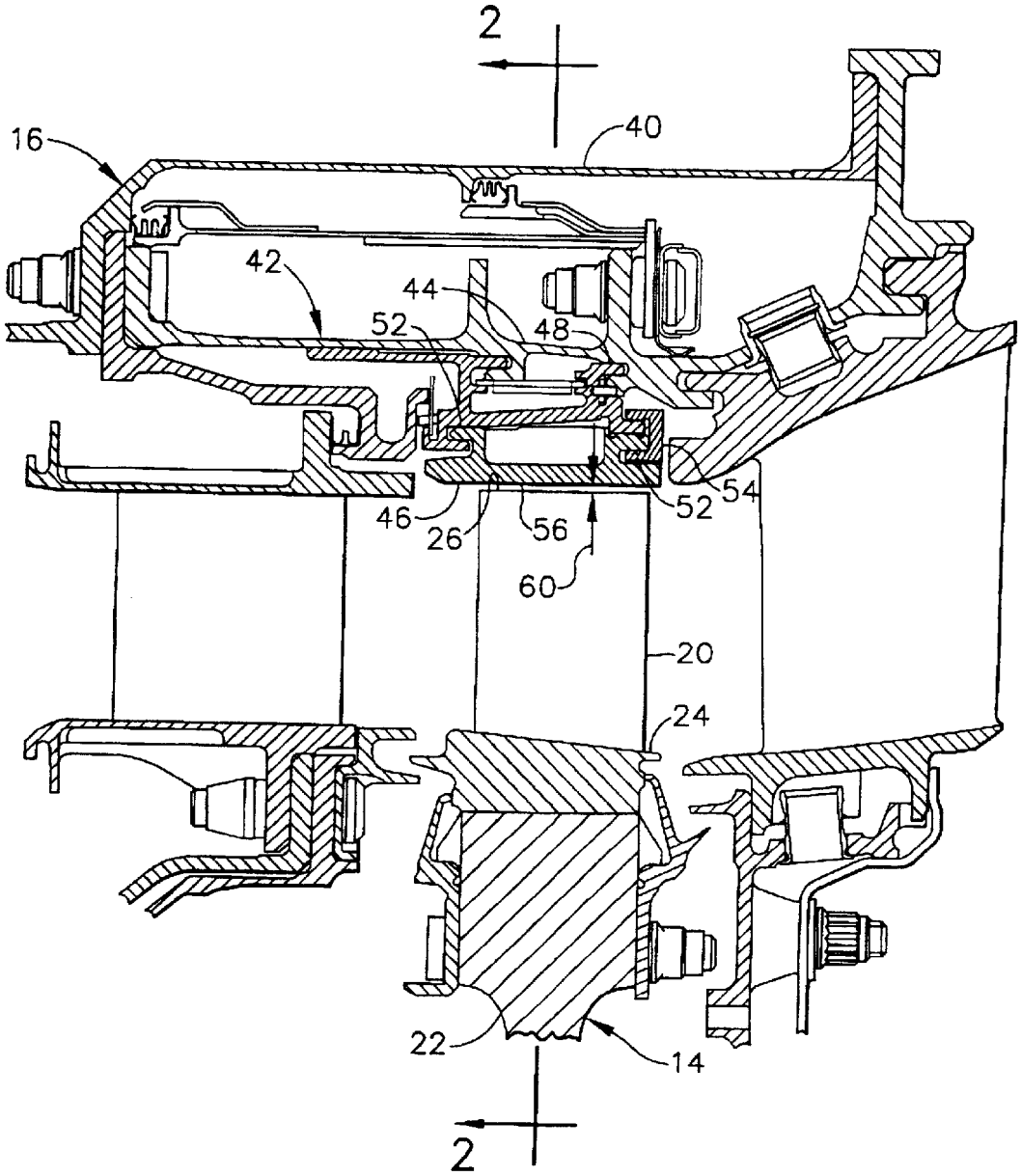
FIG. 2 is a detail vertical cross section of a portion of a high pressure turbine of the engine.

Referring now to the drawings and in particular to FIG. 1, a gas turbine aircraft engine is designated in its entirety by the reference number 10. The engine 10 includes a low pressure rotor (generally designated by 12) and a high pressure rotor (generally designated by 14) rotatably mounted on a stator (generally designated by 16) for rotation about a central axis 18 of the engine. The rotors 12, 14 have blades 20 arranged in circumferential rows extending generally radially outward from axially spaced disks 22 mounted inside the stator 16. As illustrated in FIG. 2, each of the blades 20 extends outward from a root 24 adjacent an outer diameter of the corresponding disk 22 to a tip 26 positioned outboard from the root.

As further illustrated in FIG. 1, the engine 10 includes a high pressure compressor (generally designated by 30) for compressing flowpath air traveling through the engine, a combustor (generally designated by 32) downstream from the compressor for heating the compressed air, and a high pressure turbine (generally designated by 34) downstream from the combustor for driving the high pressure compressor. Further, the engine 10 includes a low pressure turbine (generally designated by 36) downstream from the high pressure turbine 32 for driving a fan (generally designated by 38) positioned upstream from the high pressure compressor 30.

As illustrated in FIG. 2, the stator 16 is a generally tubular structure comprising an annular case 40 and an annular shroud assembly, generally designated by 42, extending generally circumferentially around the central axis 18 (FIG. 1) of the engine 10. The shroud assembly 42 includes an annular support 44 mounted locally inside the case 40 and a plurality of shroud segments 46 (e.g., 46 segments) extending substantially continuously around the support. The segments 46 are mounted on the support 44 using a conventional arrangement of hangers 48, hooks 52 and clips 54 to define a substantially cylindrical inner surface 56 of the shroud assembly 42 which surrounds the blade tips 26. All of the previously described features of the aircraft engine 10 are conventional and will not be described in further detail.

As will be appreciated by those skilled in the art, it is desirable to minimize clearances 60 between the blade tips 26 and the inner surface 56 of the shroud assembly 42 to improve engine efficiency and reduce flowpath gas temperatures. In order to reduce these clearances 60, the shroud assembly 42 (and more particularly the support 44) is cooled to reduce the radius of the inner surface 56. This cooling is accomplished by withdrawing relatively cool air from the compressor flowpath (e.g., from the fifth and ninth stages of the compressor 30), and directing this cool compressor air through pipes (not shown) extending outside the stator case 40 to the cavity formed between the case and the support 44 and to a similar cavity in the stator of the low pressure turbine 36 (FIG. 1). This air locally cools the stator 16 to reduce its thermal deflections. Because the air is introduced at discrete circumferential locations around the stator 16 (e.g., at about 20 degrees, about 65 degrees, about 155 degrees, about 200 degrees, about 245 degrees, and about 335 degrees, measured from a top of the engine and from a position aft of the support), the support 44 is not cooled uniformly over the entire circumference. As a result, the support becomes thermally distorted and is not round when the cooling air is introduced. However, when the cooling air flow is stopped, the support 44 returns to a substantially circular configuration.

The method of the present invention minimizes the clearances 60 during flight at a preselected steady state operating condition such as a cruise condition. Because the engine 10 operates for long periods of time at cruise, the greatest efficiency and temperature reduction benefits are realized by minimizing clearances 60 during this operating condition. In order to minimize the clearances 60 during flight, the stator inner surfaces 56 must be substantially circular during flight. If the radius of the inner surface 56 varies circumferentially around the assembly 42, then larger than optimal clearances will be present where the radius is larger than the minimum radius. Using the method of the present invention, a pre-machined radial clearance 60 during flight of the aircraft engine is determined at each of a plurality of circumferentially spaced locations around the shroud assembly 42. Although this determination may be made in other ways, in one embodiment this determination is made by examining historical data from a fleet of engines. Further, although the determination may be made at other numbers of circumferentially spaced locations around the assembly 42, in one embodiment the determination is made at locations corresponding to the circumferential center of each shroud segment 46.

As will be understood by those skilled in the art, when the pre-machined clearances 60 are determined from historical data, it is unnecessary to determine either the radius of the rotor blade tips 26 during flight or the radial displacements of the shroud assembly 42 during flight at the aforesaid plurality of circumferentially spaced locations around the shroud assembly. Rather, the pre-machined clearances 60 are determined by measuring after flight an average radial length by which the rotor blades were shortened during flight due to their tips 26 being abraded by the inner surface 56 of the shroud assembly 42. Because the diameter of the rotor blade tips 26 is recorded when the engine 10 is originally built, the change in diameter of the tips after flight represents twice the amount the blades were shortened during flight due to the tips 26 being abraded. In addition, the circumferential locations where the blade tips 26 contacted the inner surface 56 of the shroud assembly 42 during flight are determined by visual inspection after flight. From these observations, the pre-machined in flight clearances can be determined. Because there are variations in the initial clearances throughout the fleet of engines and different initial clearances produce different contact patterns, fairly accurate in flight clearances can be determined using conventional and well understood analyses.

Alternatively, it is envisioned that the pre-machined clearances may be determined by examining historical data from the particular engine 10 for which the shroud assembly 42 is being machined rather than by examining data from a fleet of engines. Still further, it is envisioned that rather than examining historical data to determine the pre-machined clearances 60, theoretical in flight clearances may be calculated at a plurality of circumferential locations without departing from the scope of the present invention.

Once the pre-machined clearances 60 are determined, the inner surface 56 of the shroud assembly 42 is machined based on the pre-machined radial clearances to provide a generally uniform post-machined radial clearance during flight between the rotor blade tips 26 and the inner surface of the shroud assembly at each of the circumferentially spaced locations around the shroud assembly. As will be appreciated by those skilled in the art, the amount of material removed from the inner surface 56 at any circumferential location is inversely proportional to the pre-machined clearance 60 at that location.

Figure 3:
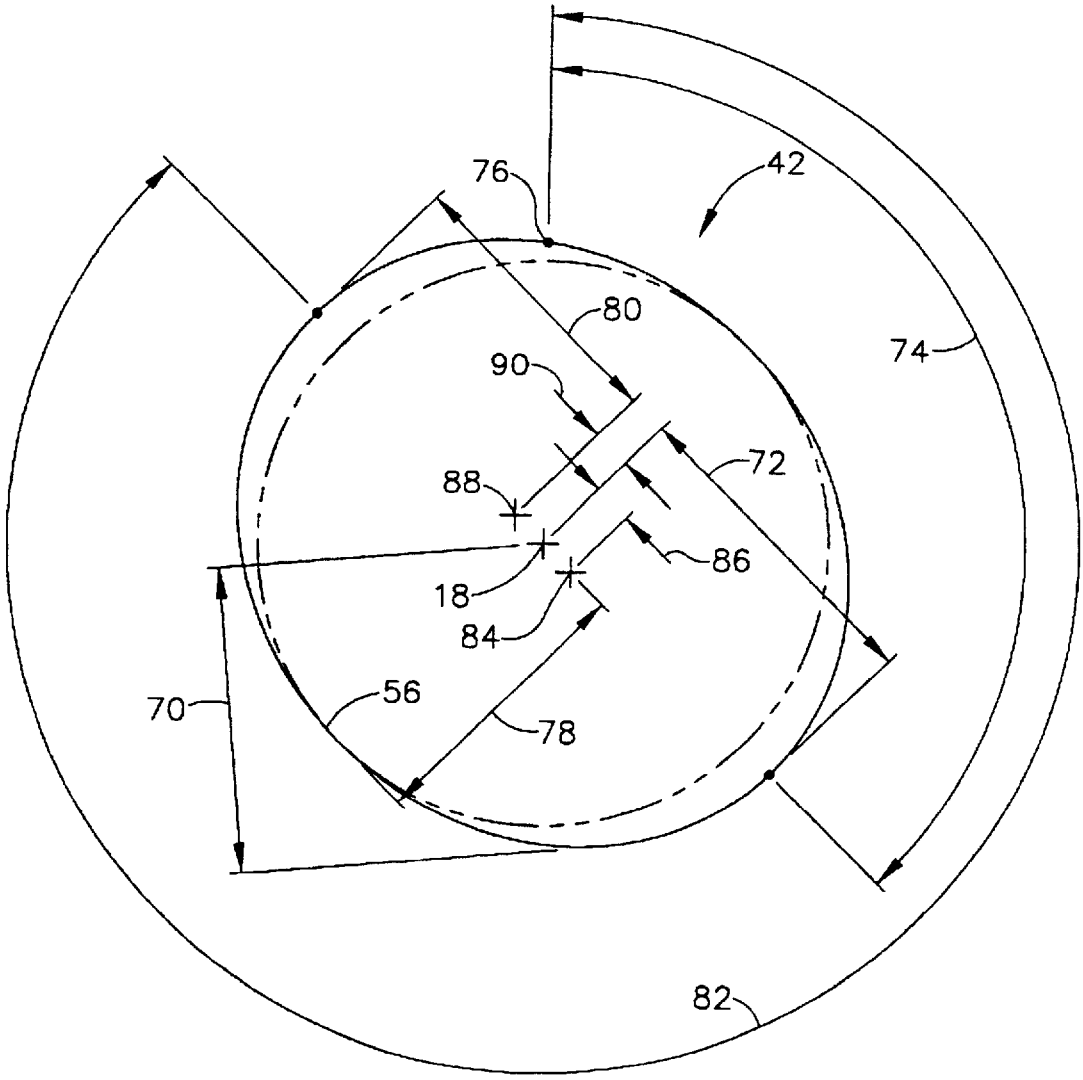
FIG. 3 is a schematic cross section taken in the plane of line 3—3 in FIG. 2 showing a shape of an inner surface of a shroud assembly of the high pressure turbine.

As illustrated in FIG. 3, the resulting shroud assembly 42 has an inner surface 56 which is spaced from the central axis 18 of the engine 10 by a distance 70 which varies circumferentially around the central axis before flight but which is substantially uniform during flight to minimize operating clearances 60 between the inner surface and the blade tips 26. Although this distance 70 may vary in other ways without departing from the scope of the present invention, in one embodiment intended for use in a high pressure turbine 32 of a CFM56-3 engine available from CFM International, SA, a corporation of France, the inner surface has an overall maximum distance 72 located at an angle 74 of about 135 degrees measured clockwise from a top 76 of the assembly 42 and from a position aft of the surface. This maximum distance 72 is about 14.410 inches or about 0.010 inches larger than a minimum distance 78 of the inner surface 56. Although the inner surface 56 may have other minimum distances without departing from the scope of the present invention, in one embodiment the minimum distance 78 is about 14.400 inches. Further, in one embodiment the inner surface 56 has a locally maximum distance 80 at an angle 82 of about 315 degrees measured clockwise from the top 76 and from the aft position. This second locally maximum distance 80 is about 14.405 inches or about 0.005 inches larger than the minimum distance 78 of the inner surface 56. As will be appreciated by those skilled in the art, the inner surface 56 may be spaced from the center central axis 18 of the engine 10 by other distances 70 without departing from the scope of the present invention. For example, if the engine 10 is assembled with shorter blades 20, the distances 70, 72, 78, 80 may be shortened to match the shorter blades. If the blades 20 are about 0.020 inches shorter than nominal, the distances 70 may be reduced by 0.020 inches to match the blades. As will further be appreciated by those skilled in the art, aircraft engines other than the CFM56-3 engine will have different distances 70, 72, 78, 80, and different angles 74, 82.

This inner surface configuration can be obtained by grinding the surface 56 to a radius of about 14.400 inches about a first grinding center 18 corresponding to the center of the support 42. Then the surface 56 is ground to a radius of about 14.395 inches about a second grinding center 84 offset by a distance 86 of about 0.015 inches from the first grinding center 18 in a first direction extending about 135 degrees from the top 76 of the assembly measured clockwise from an aft side of the support 42. Finally, the surface 56 is ground to a radius of about 14.390 inches about a third grinding center 88 offset by a distance 90 of about 0.015 inches from the first grinding center 18 in a second direction generally opposite to the first direction. As will be appreciated by those skilled in the art, alternative inner surface 56 configurations may be obtained by grinding the surface to different radii than those identified above. For example, if the engine 10 is assembled with shorter blades 20, the radii may be shortened to match the shorter blades. If the blades 20 are about 0.020 inches shorter than nominal, the radii may be reduced by 0.020 inches to match the blades.

Even though the method described above may result in a larger initial average clearance 60 when the engine is at room temperature than is accomplished using other methods, the clearance during cruise is reduced. This reduced clearance at cruise results in improved engine efficiencies and lower flowpath temperatures. Initial evaluation indicates that the flowpath temperatures may be decreased by as much as six degrees Celsius or more. Because the time between unscheduled maintenance events is frequently a function of flowpath temperatures, it is believed that using the method of the present invention can significantly increase the time between unscheduled maintenance events.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A method of machining an inner surface of a shroud assembly extending generally circumferentially around a central axis of a gas turbine aircraft engine, said engine including a disk mounted inside the shroud assembly for rotation about the central axis of the engine and a plurality of circumferentially spaced rotor blades extending generally radially outward from an outer diameter of the disk, each of said blades extending from a root positioned adjacent the outer diameter of the disk to a tip positioned outboard from the root, said method comprising:

determining a pre-machined radial clearance between the tips of said plurality of rotor blades and the inner surface of the shroud assembly during flight of said aircraft engine at each of a plurality of circumferentially spaced locations around the shroud assembly; and machining said inner surface of the shroud assembly based on said pre-machined radial clearances to provide a uniform post-machined radial clearance during flight between the tips of said plurality of rotor blades and the inner surface of the shroud assembly at each of said plurality of circumferentially spaced locations around the shroud assembly.

2. A method as set forth in claim 1 wherein determining the pre-machined clearances includes analyzing historical data from a fleet of aircraft engines.

3. A method as set forth in claim 1 wherein the pre-machined clearances are determined without determining a radius of the tips of said plurality of rotor blades during flight or determining radial displacements of the shroud assembly during flight at the plurality of circumferentially spaced locations around the shroud assembly.

4. A method as set forth in claim 3 wherein determining the pre-machined clearances includes measuring after flight an average radial length by which said plurality of rotor blades were shortened during flight due to the tips of said plurality of blades being abraded by the inner surface of the shroud assembly.

5. A method as set forth in claim 4 wherein determining the pre-machined clearances includes visually determining after flight where the tips of said plurality of blades contacted the inner surface of the shroud assembly during flight.

6. A method as set forth in claim 3 wherein determining the pre-machined clearances includes visually determining after flight where the tips of said plurality of blades contacted the inner surface of the shroud assembly during flight.

7. A shroud assembly for use in a gas turbine engine, extending generally circumferentially around a central axis of the gas turbine aircraft engine and surrounding a plurality of blades rotatably mounted in the engine, each of said blades extending outward to a tip, said shroud assembly comprising an inner surface extending generally circumferentially around the engine and outside the tips of said plurality of blades when the shroud assembly is mounted in the engine, said inner surface having a radius which varies circumferentially around the central axis of the engine before flight but which is substantially uniform during flight to minimize operating clearances between the inner surface and the tips of said plurality of blades.

8. A shroud assembly as set forth in claim 7 further comprising:

an annular support; and a plurality of shroud segments mounted on the support extending substantially continuously around the support to define said inner surface of the shroud assembly.

9. A shroud assembly for use in a gas turbine engine, extending generally circumferentially around a central axis of the gas turbine aircraft engine and surrounding a plurality of blades rotatably mounted in the engine, each of said blades extending outward to a tip, said shroud assembly comprising an inner surface extending generally circumferentially around the engine and outside the tips of said plurality of blades when the shroud assembly is mounted in the engine, said inner surface being spaced from the central axis of the engine by a distance which varies circumferentially around the central axis of the engine when the engine is stopped, said inner surface having a first locally maximum distance when the engine is stopped located at about 135 degrees measured clockwise from a top of the assembly and from a position aft of the surface, said first locally maximum distance being about 0.010 inches larger than a minimum distance of the inner surface, and a second locally maximum distance when the engine is stopped at about 315 degrees measured clockwise from the top and from the aft position, said second locally maximum distance being about 0.005 inches larger than the minimum distance of the inner surface.

10. A shroud assembly as set forth in claim 9 wherein said first locally maximum distance is an overall maximum distance of the inner surface.

11. A shroud assembly as set forth in claim 10 wherein the overall maximum distance of the inner surface is between about 14.39 inches and about 14.41 inches.

12. A shroud assembly as set forth in claim 11 wherein the overall maximum distance of the inner surface is about 14.41 inches.

13. A shroud assembly as set forth in claim 9 wherein the minimum distance of the inner surface is between about 14.38 inches and about 14.40 inches.

14. A shroud assembly as set forth in claim 13 wherein the minimum distance of the inner surface is about 14.40 inches.

15. A shroud assembly as set forth in claim 9 further comprising:

an annular support; and a plurality of shroud segments mounted in the support extending substantially continuously around the support to define said inner surface of the shroud assembly.

16. A shroud assembly extending generally circumferentially around a central axis of a gas turbine aircraft engine and surrounding a plurality of blades rotatably mounted in the engine, said shroud assembly comprising:

an annular support having a center corresponding to the central axis of the engine; and a plurality of shroud segments mounted in the support extending substantially continuously around the support to define said inner surface of the shroud assembly, wherein the inner surface is machined by grinding the surface to a radius of between about 14.380 inches and about 14.400 inches about a first grinding center corresponding to the center of the support, grinding the surface to a radius of between about 14.375 and about 14.395 inches about a second grinding center offset about 0.015 inches from said first grinding center in a first direction extending about 135 degrees from a top of the assembly measured clockwise from an aft side of the support, and grinding the surface to a radius of between about 14.370 inches and about 14.390 inches about a third grinding center offset about 0.015 inches from said first grinding center in a second direction generally opposite to said first direction.

17. A shroud assembly as set forth in claim 16 wherein the radius to which the inner surface is ground about the first grinding center is about 14.400 inches, the radius to which the inner surface is ground about the second grinding center is about 14.395 inches, and the radius to which the inner surface is ground about the third grinding center is about 14.390 inches.

* * * * *